United States Patent [19]

Albenga

[11] 3,983,923

[45] Oct. 5, 1976

[54] SAND BLOWING HEAD

[76] Inventor: Giovan Battista Albenga, Viale Matteotti 73, Pavia, Italy

[22] Filed: Apr. 1, 1975

[21] Appl. No.: 564,143

[30] Foreign Application Priority Data

Apr. 12, 1974 Italy ..... 21365/74

[52] U.S. Cl. ..... 164/201; 164/410

[51] Int. Cl.[2] ..... B22C 15/22

[58] Field of Search ..... 164/200, 201, 202, 203, 164/37, 38, 169, 192, 195, 284, 285, 306, 410, 39, 198, 204, 259, 261

[56] References Cited

UNITED STATES PATENTS

| | | | |
|---|---|---|---|
| 1,594,598 | 8/1926 | Campbell | 164/202 |
| 2,839,799 | 6/1958 | Herbruggen | 164/200 X |
| 3,181,207 | 5/1965 | Schaible | 164/201 X |
| 3,613,770 | 10/1971 | Janke | 164/192 |
| 3,659,642 | 5/1972 | Vasilkovsky | 164/202 X |

FOREIGN PATENTS OR APPLICATIONS

| | | | |
|---|---|---|---|
| 975,475 | 11/1964 | United Kingdom | 164/38 |

*Primary Examiner*—Francis S. Husar
*Assistant Examiner*—John S. Brown
*Attorney, Agent, or Firm*—Michael J. Striker

[57] ABSTRACT

A sand blowing head includes an air accumulator above a tank in which a metered quantity of sand may be charged. The tank is charged when offset from the accumulator and is movable to a blowing position in which an upper tank inlet is aligned with a downwardly extending outlet from the accumulator. A seal between the inlet and outlet is provided.

12 Claims, 2 Drawing Figures

SAND BLOWING HEAD

BACKGROUND OF THE INVENTION

1. Field of the Invention

This invention relates to heads for blowing sand into moulds for the production of foundry cores.

2. Description of the Prior Art

The mass production of foundry cores involves the use of moulds or core-boxes, usually mounted onto presses, and into which the sand is blown by a jet of air, in order to obtain a compact and even arrangement of sand in the mould.

Known blowing heads comprise stationary components forming a stationary assembly including an upper hopper for storing the sand, a tank placed beneath the hopper suitable for receiving metered quantities of sand, both the hopper and the tank being axial arrangement with respect to the closing plane of the dies forming the mould or core-box, a pressurized air accumulator offset from the axis and connected to the tank by means of valves which periodically let the jet of air pass through the tank to blow the metered quantity of sand in the tank into the mould.

The sand falls from the hopper into the tank through a gated opening which can close-off the hopper from communication with the tank.

Such a system has disadvantages.

A first disadvantage is that the position of the pressurized air accumulator with respect to the tank results in tortuous air pressure lines whose cross-section is restrictive, so that in order to obtain the air pressure required at the tank and to overcome the frictional losses in air pressure, the air pressure in the accumulator has to be increased and a larger accumulator used.

A second disadvantage is that in order to reach the internal elements of the head almost entire disassembly of the head is required thus resulting in considerable time being taken up for cleaning and maintenance of the head.

A third disadvantage concerns the difficulty of removing sand from the walls of the tank, owing to the fact that the jet of air is guided in a manner as first to impact the sand in the internal space of the tank, and second to flow along a peripheral hollow space provided between the outer wall of the tank and an internal net for entrapping the sand, the net having the purpose of letting a flow of air pass through it for detaching the sand from the tank. Of course, the first impact of the jet of air against the mass of sand to blow it into the mould or core-box would push the sand against the internal net thus hampering the detachment of the sand and its deposition into the mould or core-box.

A fourth disadvantage is that the gate which controls communication from the hopper to the tank can be clogged by the sand, and is subjected to continuous pressure pulses caused by jets of air against the tank, which pulses cause the gate sealing packings to wear out quickly.

SUMMARY OF THE INVENTION

The present invention aims to reduce these difficulties.

According to the present invention there is provided a head for blowing sand into moulds for the production of foundry cores, wherein the sand metered into a tank in the head is forced into the mould by a jet of air delivered from an air accumulator, said head comprising an air accumulator having a downwardly extending outlet; valve means to control opening and closing of the outlet; a tank below the accumulator outlet; the tank having an upper inlet and being movable between a first position whereat said inlet is aligned with the accumulator outlet and a second position whereat said inlet is offset from the accumulator and at which said tank may be charged with a metered quantity of sand; and pressure-applying means for sealingly engaging the accumulator outlet with the inlet to the tank when in said first position.

With the invention there may be only small frictional loss of air pressure when creating the required air pressure in the tank owing to the preferred arrangements of the air accumulator outlet. There can be rapid access to the internal elements without requiring the disassembly of the head and the air jet can be guided to produce the best conditions for the detachment of sand from the walls of the tank.

The downwardly extending outlet of the blowing head preferably comprises a mouthpiece at the bottom of the accumulator, and air passages to supply said mouthpiece.

The valve means may be located in the mouthpiece.

The air passages provided on the bottom of the accumulator may be vertical holes arranged along a periphery and the valve means in the lower opening may comprise an annular pad the centre periphery of which passes along the axis of the holes, a jack suitable to move the pad to open or close the passages and with a capacity sufficient to overcome the air pressure when the pad is in the closed position.

According to another preferred feature the pad is supported by the ends of the arms of a spider, the arms extending from a central hub which is mounted axially onto the stem of the jack.

The tank preferably comprises an outer wall and a perforated inner wall which is spaced inwardly from the outer wall to form a hollow space.

Preferably also the jack projects beyond the mouth of the lower opening and has mounted on the projecting portion a membrane having a flexible peripheral annulus which projects into the tank in such a manner that, during the inital rise in air pressure after the air passages are opened, the membrane annulus stays undeflected to divert the rise in air pressure towards the hollow space between the walls of the tanks to transversely compress the sand in the tank and loosen it from the perforated inner wall, and then the membrane annulus deflects with the increase in air pressure to allow the air pressure to pass directly into the tank. Through the use of this method, the means for applying axial pressure to the accumulator-tank-mould assembly is suitable to move axially the accumulator, low opening and valve means to allow sufficient axial movement to remove the membrane and the projecting portion of the jack from the tank in order to allow the tank to move to and from a sand-loading hopper.

An example of the present invention is described in detail and shown in the attached drawings, in which:

DESCRIPTION OF THE PREFERRED EMBODIMENT

Figure 1:
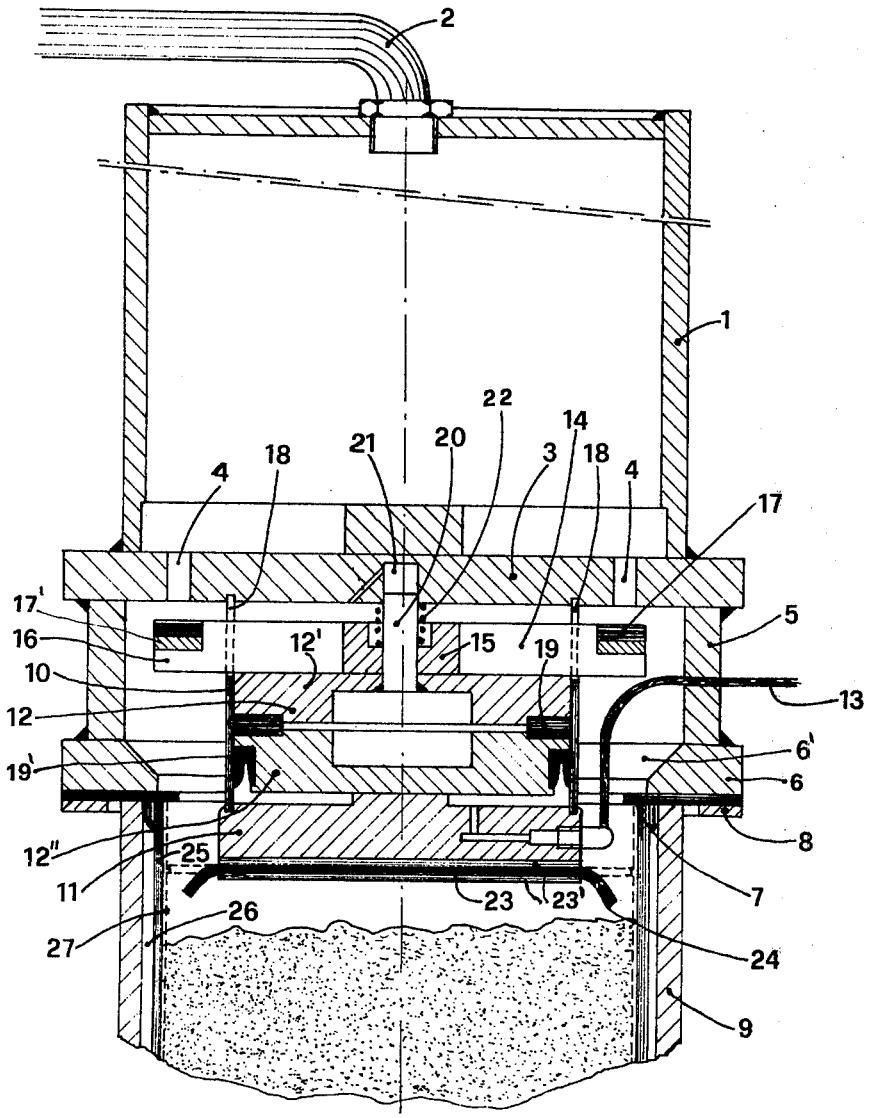
FIG. 1 is an axial section of the blowing head and part of the tank for sand.

In FIG. 1 of the drawings, 1 indicates the accumulator for the pressurized air fed through a line 2. The bottom plate 3 of the accumulator 1 is perforated by a plurality of vertical holes 4 (only 2 shown) distributed along its periphery.

Under the bottom plate 3 is welded a mouthpiece 5 to which is welded a plate 6 with a downward and inward taper to an opening 6′ to form a downwardly extending outlet.

Around the edge of the opening 6′ is mounted a sealing packing 7 which is retained by means of a peripheral ring 8.

The opening 6′ opens into a tank 9 for housing sand, the edge of the upper inlet of the tank 9 abuts the sealing packing 7.

In the downwardly extending outlet there is a valve means to control the opening and closing of the holes 4. The valve means will now be described.

To the bottom plate 3 is secured one end of a cylinder 10 which is coaxial with respect to the vertical axis of symmetry of the plurality of holes 4. A head 11 is secured to the other end of the cylinder 10. A piston 12 slides within the cylinder 10, and this piston forms with the cylinder 10 a single-acting jack, which is fed through a line 13 with pressurized fluid.

On the piston 12 rests a spider 14, the radial arms of which extend from a central hub 15 coaxial with the piston 12 and carrying on their free ends 16 an annular support ring 17′ which supports an annular pad 17, the central circumference of which coincides with the circumference passing through the axis of the holes 4; and accordingly the pad 17 operates as a closing member for the holes 4 when the piston 12 is urged upwardly.

The arms of the spider 14 pass through radial slots 18 (only two shown) provided in the cylinder 10; the slots 18 extending to the upper edge of the cylinder 10. Thus the spider 14 may be constructed by inserting the radial arms through the slots 18.

The piston 12 comprises two parts 12′ 12″ separated with respect to one another by means of a flexible gland 19 which allows clearance between the two piston parts 12′ and 12″ and the interior surface of the cylinder 10. The lower piston part 12″ carries an annular seal 19′.

The upper piston part 12′ has a coaxial stem 20 penetrating axially into a blind bore 21 in the bottom plate 3 of the accumulator 1, the stem 20 passing through the hub 15 of the spider 14 and being encircled with a spring 22 which abuts against the bottom plate 3 and the hub 15 to separate the hub 15 and the spider 14 from the bottom plate 3.

The connection of the upper piston part 12′ to the bottom plate 3 has the advantage that should seepages of sand, seizures or likewise occur, which tend to move the piston to an eccentric position, the upper piston part 12′, being always guided, will resist the movement to eccentricity, and thus ensure that the annular pad 17 carried by the upper piston part 12′ seals the holes 4 against the passage of air.

As shown in FIG. 1, the head 11 of the cylinder 10 projects into the tank 9 and has on its lower surface, which is below the upper edge of the tank, a transverse membrane 23 which is clamped to the head 11 between the two discs 23′ and which has a peripheral annulus 24 of resilient material, such as rubber or other elastomer material. The annulus 24 has the purpose of deviating under air pressure from the position (shown in phantom lines) to the position shown in full to divert the air jet as will be described hereunder, and also has the purpose of preventing the upward movement of air and sand into the mouthpiece 5.

The peripheral edge of the annulus 24 almost touches an inner wall 25 made of perforated material which is an internal lining of the solid outer wall of the tank 9 and which is spaced from this solid wall to form a cylindrical hollow space 26. The perforated wall 25 is internally lined with a mesh 27 capable of entrapping grained sand to prevent sand from entering the hollow space 26. The edge of the flexible annulus 24 is spaced below the edge of the tank 9 such that an annular section of the perforated wall 25 is separated from the remainder of the perforated wall 25 by the annulus 24 when in the initial position (shown in phantom line).

Figure 2:
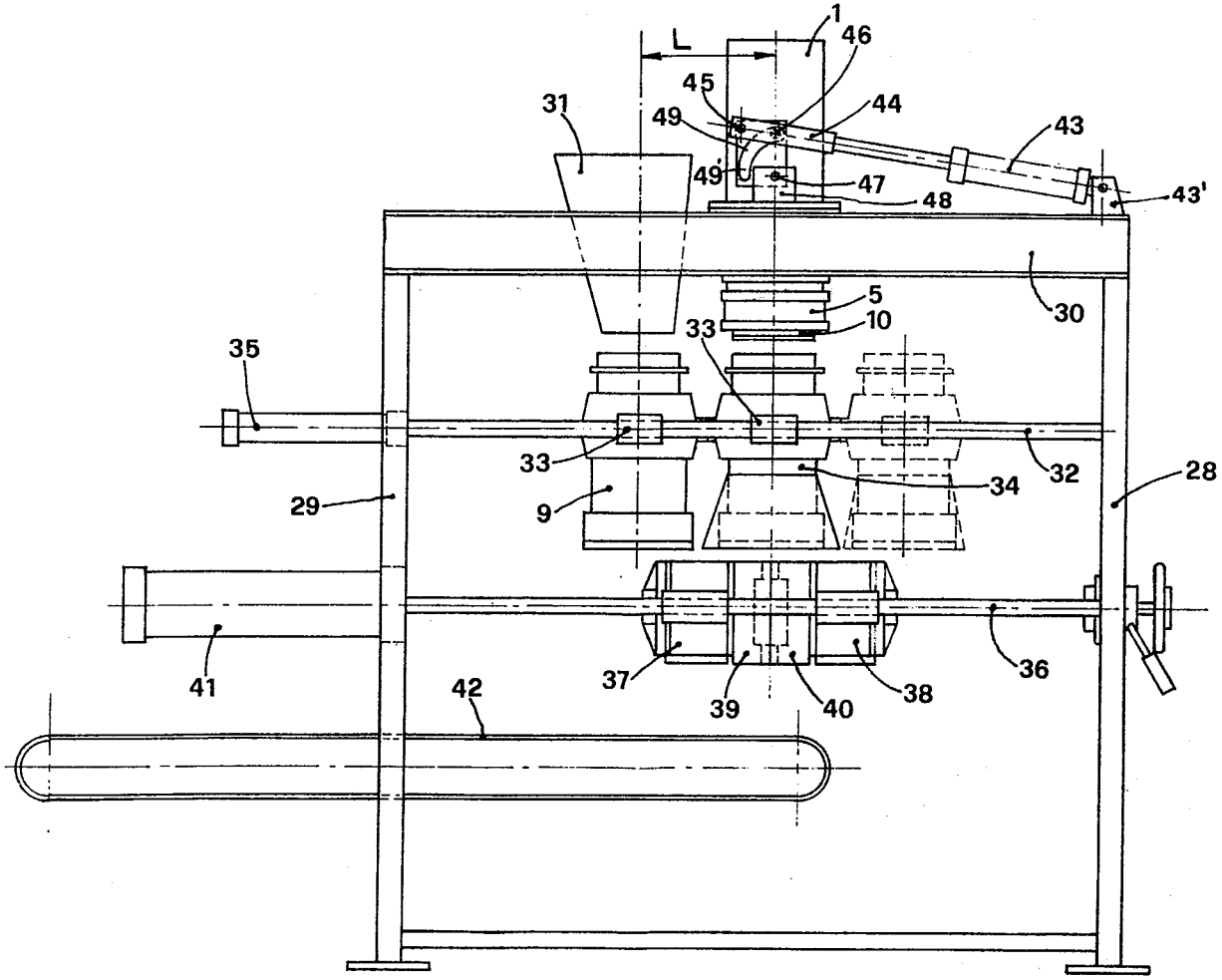
FIG. 2 is a diagram of a press formoulding foundry cores on which press the blowing head of FIG. 1 is mounted.

As shown in FIG. 2, the press on which is mounted the blowing head of FIG. 1 comprises a bearing frame with two vertical lateral front sides 28 and 29 connected at the upper portion by means of a beam 30. Since the frame is shown in FIG. 2 as a front view, it is evident that the frame has depth perpendicular to the plane of the drawing, and thus the two frame sides 28 and 29 are each formed by at least two vertical uprights connected by means of lattice elements, and the beam 30 is formed by at least two parallel horizontal members spaced apart to define a space sufficient for the passage and support of elements on the frame.

The beam 30 supports the accumulator 1 so that the mouthpiece 5, the head 11 of the cylinder 10, and the flexible annulus 24 will project below the beam 30.

The beam 30 also supports a hopper 31 at the side of the accumulator 1, which also projects below the beam. The vertical central axis of the hopper 31 is separated from the vertical central axis of the accumulator 1 by a distance (L).

Within the frame and connected to the uprights of the frame sides 28 and 29 is arranged a first pair of parallel horizontal rods 32 (only one visable — the other being hidden by being behind the shown one). The tank 9 for the sand and a degassing device 34 of a known type used when the sand is hardened through a known chilling process are slidably supported on the rods 32 by means of the sleeves 33.

The tank 9 and the degassing device 34 are connected together and have the same distance between their vertical axis and the distance (L) between the axis of the hopper 31 and the tank 9.

A pneumatic or hydraulic jack 35 of the double-acting type is supported by the uprights (not shown) of the frame side 29 and has its stem horizontally extending between the bars 32 to move the tank 9 and the degassing device 34 between the first position where the tank is under the accumulator 1 as shown in FIG. 1 and the degassing device 34 is shown in phantom lines at the right-hand side of FIG. 2 and a second position where, as shown in full lines in FIG. 2, the tank 9 is under the hopper 31 and the degassing device 34 is under the accumulator 1. Of course, the filling stage of the tank occurs at the same time as the degassing stage, and therefore the motion of the tank does not influence the time of each single operating cycle.

A pair of bars 36, similar to and connected at a lower level than the pair of bars 32, is provided for supporting the respective die holder members 37 and 38 each supporting a die 39 and 40 respectively. The join plane of the dies occurs along the vertical plane passing through the vertical axis of the blowing head.

At least one of the die holder members is movable along the bars 36 by a double-acting jack 41 between the closed position shown and an opened position which allows the moulded piece to be ejected in a known manner.

A continuous conveyor belt 42 is arranged below the die 39 and 40 to take away the moulded pieces ejected from the die 39 and 40. The accumulator 1 is connected to a means for applying pressure to move the blowing head vertically between a raised position, shown in FIG. 2, wherein the parts of the blowing head entering the tank 9 are raised above the upper edge of the tank, and a lowered position wherein the parts of the blowing head will seal against the tank and project into it, as shown in FIG. 1.

The pressure-applying means comprises, for example, a double-acting hydraulic jack 43 the centre of which is pivotally connected to a bracket 43' mounted on the frame 30 and the stem of which terminates in a fork 44 encircling the accumulator 1. Each of the arms of the fork 44 are hinged at the pivot 45 near a corner of a rectangular plate 49. This plate 49 has an arcuate slot 49' extending as an arch for at least 90°, and slidably guiding a pin 46 secured to the accumulator 1.

Moreover, the plate 49 is hinged by a pin 47 to a stationary support 48 which is mounted on the beam 30 to allow the accumulator 1 to slide actually therein. The arcuate slot 49' curves around the pivot point of the pin 47 so that the slot 49' is at an increasing distance from the pin 47 in one longitudinal direction of the slot. The hinge formed by the pin 47 allows the plate 49 to reciprocate about the pin 47 as the jack 43 alternately extends and retracts for fork 44. The extended position of the fork 44 is shown in FIG. 2 where the blowing head is in the raised position. When the fork 44 is retracted, the plate 49 and the slot 49' rotate clockwise through about 90° and the pin 46 secured to the accumulator 1 will be guided by the slot 49' along a vertically downward path within the support 48. At the fully retracted position the pin 46 will be at the other end of the slot 49', which other end is nearer one to the pivot 47, so that the blowing head will have been lowered by the difference (shown in FIG. 2) between the vertical distance between the centres of pin 46 and the pin 47 and the horizontal distance between the centres of the lower end of the slot 49' and the pin 47.

The operation occurs as follows:

Initially, the tank 9 is at the position shown in FIG. 2, wherein it is loaded with a metered quantity of sand from the hopper 31.

At the same time, the blowing head is raised to the position shown in FIG. 2 and the accumulator 1 is fed with pressurized air. The holes 4 are sealed by the annular pad 17 since air pressure is applied to the piston 12 through the line 13. At the end of this operation, the tank 9 is aligned actually with the blowing head by the action of the jack 35. Then the jack 43 is operated to cause the blowing head to be lowered and the pressure on the pins 46 exerted by the slots 49' will impart a downward pressure which causes the mouthpiece 5 and the tank 9 to seal together and the tank 9 and die 39 and 40 to seal together. The die 39 and 40 remain closed during the operations. The downward pressure imparted to seal the mouthpiece 5 and the tank 9 and the tank 9 to the die 39 and 40 prevents the their separation under the internal pressure due to the air pressure on the sand inside the tank 9.

When the tank 9 is sealed to the mouthpiece 5, the die 39 and 40 is opened and the moulded piece is ejected onto the conveyor belt 42, and the pressure in the line 13 connected to the cylinder 10 is reduced, and thus the piston 12 is abruptly thrust downwards by the combined action of the air pressure in the accumulator acting on the annular pad 17, and the weight of the piston 12, and the pressure of the spring 22.

The air accumulated in the accumulator 1 is vented through the holes 4 and past the annular pad 17 and into the mouthpiece 5 connected to the tank 9.

The flexible annulus 24 is in the initial position (shown in phantom lines in FIG. 1) and will initially form an obstacle which will deflect the air and force it to pass through the upper section of the perforated wall 25 and to flow through the hollow space 26, thus pushing against sand to compress the sand transversely and loosen the sand from the mesh 27.

After an interval, the pressure of the air will cause the annulus 24 to deflect in the downward direction, as shown in full lines in FIG. 1, thus permitting the passage of the air jet to the sand to force the loosened sand out of the tank 9 into the die 39 and 40.

Once the blowing operation is completed, the blowing head is raised and the tank 9 is moved toward the sand-loading station.

From the above description, the present invention results in the following advantages.

A first advantage results from the manner of communication between the air accumulator 1 and the tank 9 for the sand. The holes 4 used with the annular pad 17 provide a large passage without tortuosity for the jet of air, thus allowing a decrease in the accumulator air pressure and a consequent saving of power and current.

Moreover, the direct communication between the accumulator 1 and the tank 9 will prevent troubles due to the gated opening previously used which could shut off passage between the hopper and the stationary tank.

As illustrated above the flexible annulus 24 also has the purpose of controlling the jet of air and keeping the sand from moving upward into the mouthpiece 5.

The elements of the blowing head are easily accessible because the tank 9 is readily moveable from the blowing head, and because of the arrangement of the valve members within the mouthpiece 5. This ease of access results in a major saving of the time for cleaning and maintenance operations.

In addition, the blowing is simpler than those of the prior art; and is combined with a faster performance time of the operating cycles, and therefore results in an important increase in production rate.

Of course, the present invention may be made in other forms, differing with respect to the embodiment illustrated above, while the characteristics of this invention, as summarized by the claims, may be used together or separately, while still lying within the boundries of the invention, as those skilled in the art will well understand.

I claim:

1. A head for blowing sand into moulds for the production of foundry cores, wherein the sand metered into a tank in the head is forced into the mould by a jet air delivered from an air accumulator, said head comprising:

a. An air accumulator having a downwardly extending outlet having a mouthpiece at the bottom of said accumulator and air passages to supply said mouthpiece;

b. A valve means in said mouthpiece to control opening and closing of the outlet;

c. A tank below the accumulator outlet, the tank having an upper inlet and being movable between a first position whereat said inlet is aligned with the accumulator outlet and a second positon whereat said inlet is offset from the accumulator and at which said tank may be charged with a metered quantity of sand; and d. Pressure-applying means connected to said accumulator for sealingly engaging the accumulator outlet with the inlet to the tank when in said first position.

2. A blowing head according to claim 1, in which said tank comprises an outer wall and a perforated inner wall which is spaced inwardly from the outer wall.

3. A blowing head according to claim 2, in which said valve means further comprises a resilient membrane extending beneath said outlet to said interior wall when said tank is in said first position, said membrane being flexible under air pressure from said outlet.

4. A blowing head according to claim 1, in which said valve means comprises an annular pad for closing said air passages, and valve control means for moving the pad to close said passages and to maintain said passages closed against the pressure of air within said accumulator.

5. A blowing head according to claim 4, in which said valve control means comprises a fluid-operated jack.

6. A blowing head according to claim 5, including a stem to said jack, a central hub on said stem and a spider projecting from said central hub and supporting said pad.

7. A blowing head according to claim 6 in which said jack comprises a piston within a cylinder; and in which the piston comprises upper and lower relatively movable parts, a flexible gland between the two piston parts within the cylinder, said stem being mounted on said upper piston part, and hole in the bottom of said accumulator, said stem being guided in said hole.

8. A blowing head according to claim 5, in which said jack projects from said mouthpiece to enter said tank when in said first position; in which said tank comprises an outer wall and a perforated inner wall which is spaced inwardly from the outer wall; in which said valve means further comprises a resilient membrane extending beneath said outlet to said inner wall when said tank is in said first position, said membrane being flexible under air pressure from said outlet; and in which the projecting portion of said jack supports said membrane.

9. A blowing head according to claim 1, in which said pressure-applying means is adapted axially to move said accumulator, said downwardly extending outlet, and valve means between the first position where said outlet is in abutment with the upper inlet of said tank and a second position where said outlet is spaced from the upper inlet of said tank such that said tank is movable to its second said position.

10. A moulding apparatus for moulding foundry cores, said apparatus comprising a frame; a blowing head as claimed in claim 1 mounted on said frame; a mould having two parts closable on a vertical axial plane, the mould being disposed on the frame on the opposite side of the tank to the outlet and being in fluid communication with the tank when in said first position; means operatively connected to said tank to move said tank between said first position and said second position; and said pressure-applying means being additionally adapted sealingly to engage said tank with said mould, whereby, in use, when said valve means opens said outlet, the pressurized air in the accumulator is released to increase the air pressure in said tank to blow the sand in the tank into the mould.

11. A moulding apparatus according to claim 10, and further comprising means mounted on said frame to load sand into said tank; and means mounted on said frame to receive moulded sand articles ejected from said mould.

12. A moulding apparatus according to claim 10, in which said pressure-applying means comprises a pair of plates each pivotally mounted on said frame, each plate having an arcuate slot therein curved around said frame and pivot point and at an increasing distance from said point in one longitudinal direction of the slot; a pair of pins mounted on said air accumulator and slidably engaging respectively in said arcuate slots; a yoke having two limbs and a stem, the two limbs being pivotally connected to the pair of plates; a double-acting cylinder and piston unit connected to the stem of said yoke and pivotally connected to said frame; whereby expansion and contraction of said piston in said cylinder urges said air accumulator upwards and downwards.

* * * * *